US007861448B2

(12) United States Patent
Povilaitis

(10) Patent No.: US 7,861,448 B2
(45) Date of Patent: Jan. 4, 2011

(54) BANNER MOUNTING ASSEMBLY AND METHOD

(76) Inventor: Darius A. Povilaitis, 3418 N. Knox Ave., Chicago, IL (US) 60641

( * ) Notice: Subject to any disclaimer, the term of this patent is extended or adjusted under 35 U.S.C. 154(b) by 97 days.

(21) Appl. No.: 12/140,697

(22) Filed: Jun. 17, 2008

(65) Prior Publication Data

US 2009/0307949 A1 Dec. 17, 2009

(51) Int. Cl.
*G09F 1/12* (2006.01)

(52) U.S. Cl. ..... 40/603; 40/739; 40/793; 40/791

(58) Field of Classification Search ..... 40/707, 40/739, 740, 779, 790, 794, 603, 604, 793
See application file for complete search history.

(56) References Cited

U.S. PATENT DOCUMENTS

| | | | | |
|---|---|---|---|---|
| 1,882,454 | A | 10/1932 | Spalding | |
| 3,080,166 | A * | 3/1963 | Clark | 273/407 |
| 3,978,905 | A | 9/1976 | de Lama et al. | |
| 4,041,861 | A | 8/1977 | Alter | |
| 4,145,828 | A | 3/1979 | Hillstrom | |
| 4,459,773 | A * | 7/1984 | Sandlin et al. | 40/739 |
| 4,580,361 | A | 4/1986 | Hillstrom et al. | |
| 4,674,213 | A | 6/1987 | Keithley | |
| 4,754,566 | A | 7/1988 | Gordon | |
| 4,773,174 | A | 9/1988 | Boeniger et al. | |
| 4,800,947 | A | 1/1989 | Loomis | |
| 5,099,590 | A * | 3/1992 | Yamaguchi | 40/711 |
| 5,159,770 | A | 11/1992 | Yamaguchi | |
| D388,618 | S * | 1/1998 | Allekotte | D6/312 |
| 5,732,494 | A | 3/1998 | Davey | |
| 5,950,343 | A * | 9/1999 | Dingle | 40/793 |
| 6,088,942 | A | 7/2000 | Brooks et al. | |
| 7,117,620 | B2 | 10/2006 | Tolna | |
| 7,168,197 | B2 | 1/2007 | Siegenthaler | |

OTHER PUBLICATIONS

ABC Sign Products, "Technical Procedures," (2007). Retrieved from the Internet on May 22, 2007: URL:http://www.abcsignproducts.com/Florida/procedures/floridaindex.htm.

(Continued)

*Primary Examiner*—Joanne Silbermann
*Assistant Examiner*—Shin Kim
(74) *Attorney, Agent, or Firm*—Marshall, Gerstein & Borun LLP

(57) ABSTRACT

A banner mounting assembly 10 is disclosed. The banner mounting assembly 10 includes a frame assembly 11 having a top frame 12 and a bottom frame 14 disposed beneath the top frame. The top frame 12 has four sections 12*a*, 12*b*, 12*c*, and 12*d*, and the bottom frame 14 has four corresponding sections 14*a*, 14*b*, 14*c*, and 14*d*. Clamp assemblies 20 disposed on each bottom frame section 14*a*, 14*b*, 14*c*, and 14*d* of the frame assembly 11 secure a banner 16 or other advertisement media to the frame assembly 11 after the banner 16 has been disposed within the frame assembly 11. Each of the top frame sections 12*a*, 12*b*, 12*c*, and 12*d* is hinged to the corresponding bottom frame sections 14*a*, 14*b*, 14*c*, and 14*d*, thereby allowing the top frame sections 12*a*, 12*b*, 12*c*, and 12*d* to be moved between a closed position and an open position.

19 Claims, 16 Drawing Sheets

OTHER PUBLICATIONS

ABC Sign Products, "Wind Speed and Design Criteria for Flexible Face Sign Construction with ABC Extrusions," (2007). Retreived from the Internet on May 23, 2007: URL:http://www.abcsignproducts.com/Florida/index.htm.
Ackland Media Frames, Media Kit (2005).
Digital Photograph 1 (admitted to be publicly available at least one-year before filing date).
Digital Photograph 2 (admitted to be publicly available at least one-year before filing date).
Digital Photograph 3 (admitted to be publicly available at least one-year before filing date).
Digital Photograph 4 (admitted to be publicly available at least one-year before filing date).
Digital Photograph 5 (admitted to be publicly available at least one-year before filing date).
Digital Photograph 6 (admitted to be publicly available at least one-year before filing date).
Grant Sign Service, Inc., "The Frameless Face System," (2008). Retrieved from the Internet on May 22, 2007: URL:http://www.grantsignservice.grantsigngroup.com.
McGill Marketing Group, "ClipsIn" Banner Retaining System, Brochure (2009).

* cited by examiner

BANNER MOUNTING ASSEMBLY AND METHOD

TECHNICAL FIELD

This disclosure relates generally to devices for mounting large advertisements and the like, and, more particularly, to a banner mounting assembly.

DESCRIPTION OF RELATED TECHNOLOGY

Methods of displaying advertisements, banners and similar large signs are known. For example, one commonly used method of displaying banners includes mounting banners of all sizes to an exterior or interior wall or wall surface. Small banners typically have reinforced edges with grommet holes, as shown, for example, in FIG. 1. Ropes or bungee cords are tied or hooked through these grommet holes and pulled snug. Alternatively, screws are driven through the grommet holes directly into the wall, thereby allowing the small banner to be displayed relatively flush to a wall.

The display of large banners often requires professional installation. Typically, large exterior or interior wall mounted banners require pole pockets on all four sides of the banner, as shown, for example, in FIG. 2. Metal or wood shaped poles are then inserted into all four banner pole pockets. Threaded J-shaped hooks grip the poles at various points for stretching. Permanently mounted anchor plates disposed on sides of buildings, for example, accept the threaded J-hooks for tensioning. Spinning a nut on a J-hook allows the banner to be pulled in an outward direction for tensioning. Alternatively, bungee cords may be used to stretch the banner in lieu of the threaded J-hooks.

Such mounting methods, however, have several disadvantages. For example, the first, most common mounting method (FIG. 1) described above fails to adequately stretch the banner for a smooth, drum tight presentation. Instead, the banner includes sags and ripples on its face, detracting from and often interfering with any message or advertisement displayed on the banner. Also, the anchoring areas, J-hooks, bungee cords, and ropes are all unsightly and fully visible on the mounting wall. Still further, for all of the mounting methods described above, wind may creep under the banners, potentially stretching and causing a rippling effect on the banner during heavier wind and poor weather conditions.

Another mounting method utilizes a special metal frame that "floats" off of a wall, as shown, for example, in FIG. 3, allowing bungee tightening of the banner from behind the banner. However, this method also easily allows wind to get behind the banner in outside applications, for example, potentially stretching, flapping, or even blowing out the banner during high winds and extreme weather conditions.

Other frames require positioning of all four sides of the banner in a frame and the use of custom tools for mounting the banner into the frame. The process requires special instruction and knowledge and is time-consuming.

BRIEF DESCRIPTION OF THE DRAWINGS

Objects, features, and advantages of the present disclosure will become apparent upon reading the following description in conjunction with one or more of the following figures.

DETAILED DESCRIPTION OF THE DISCLOSURE

Figure 1:
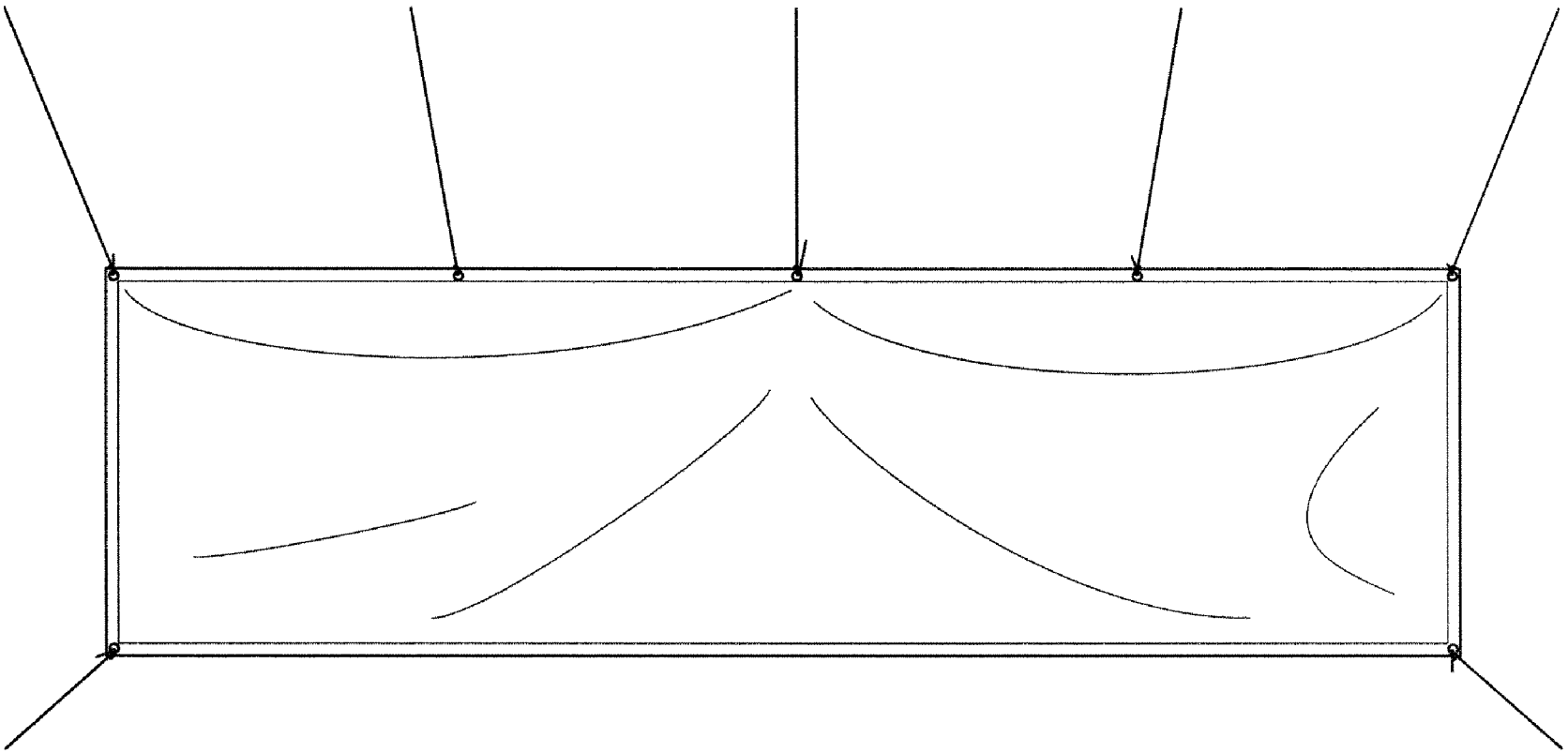
FIG. 1 PRIOR ART
FIG. 1 is a front perspective view of a prior art banner mounting system for a small banner.
Figure 2:
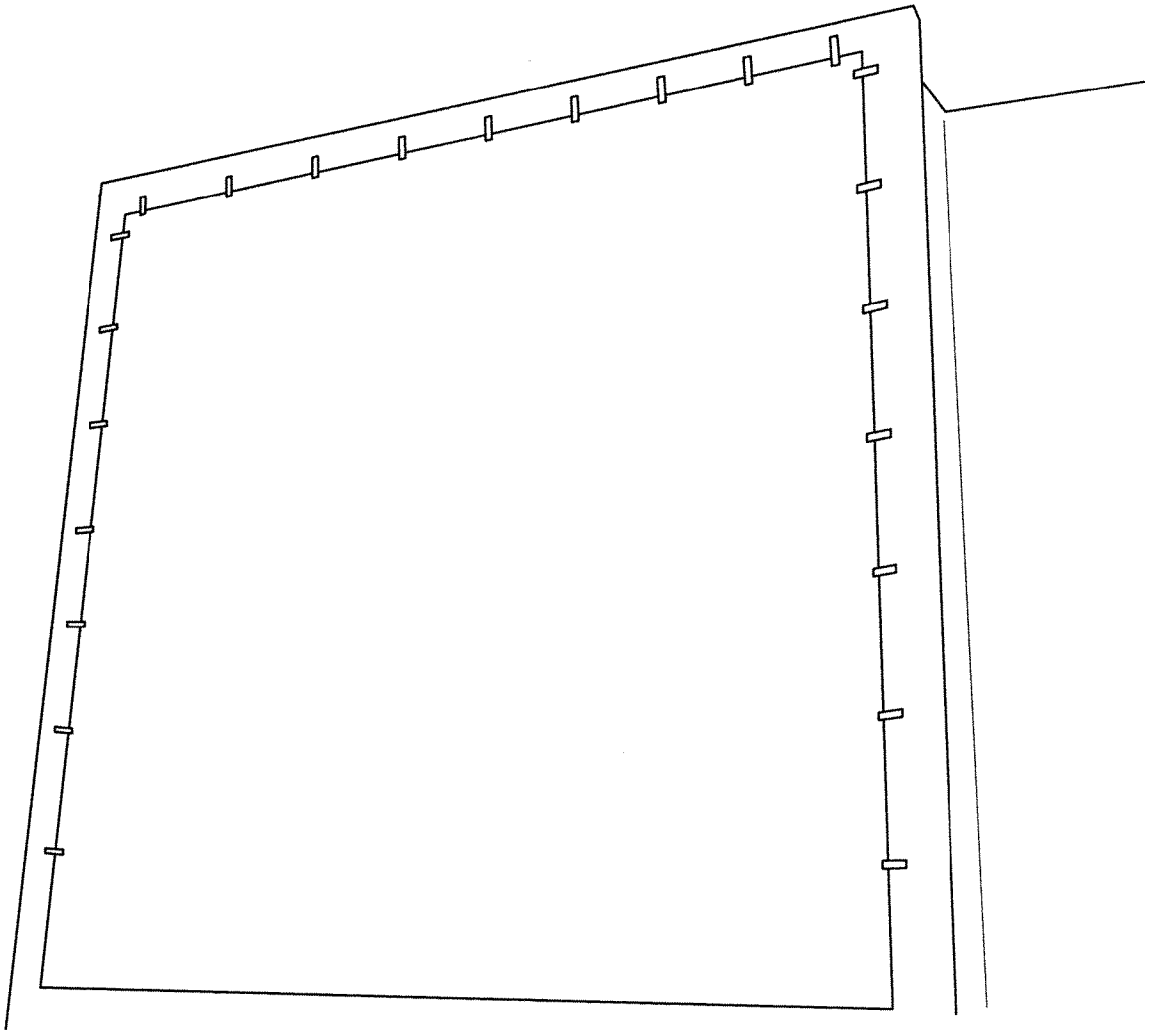
FIG. 2 PRIOR ART
FIG. 2 is a front perspective of a prior art banner mounting system for a larger sized banner.
Figure 3:
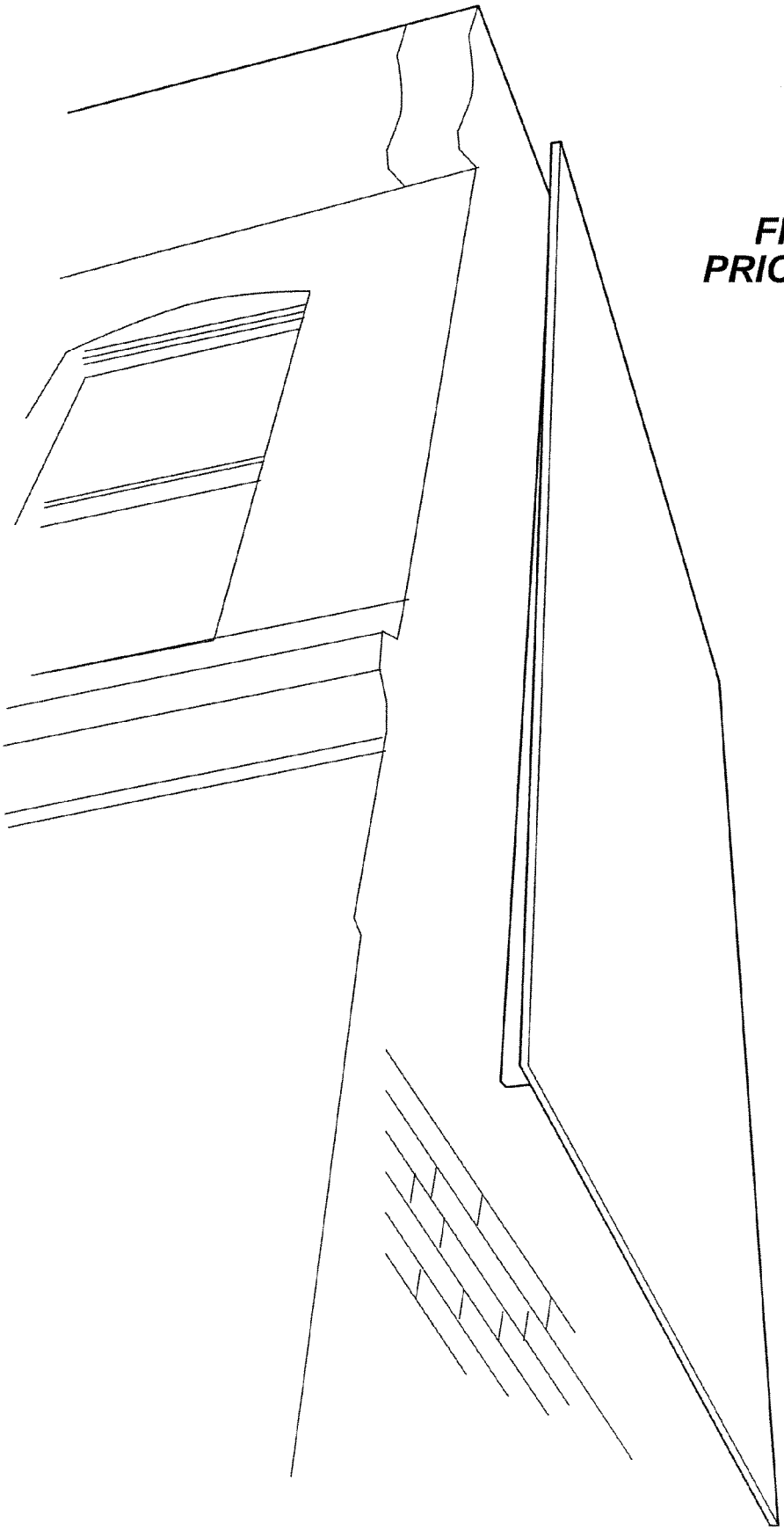
FIG. 3 PRIOR ART
FIG. 3 is a side perspective view of a prior art banner mounting system for a larger sized banner using a floating mounting system.
Figure 4:
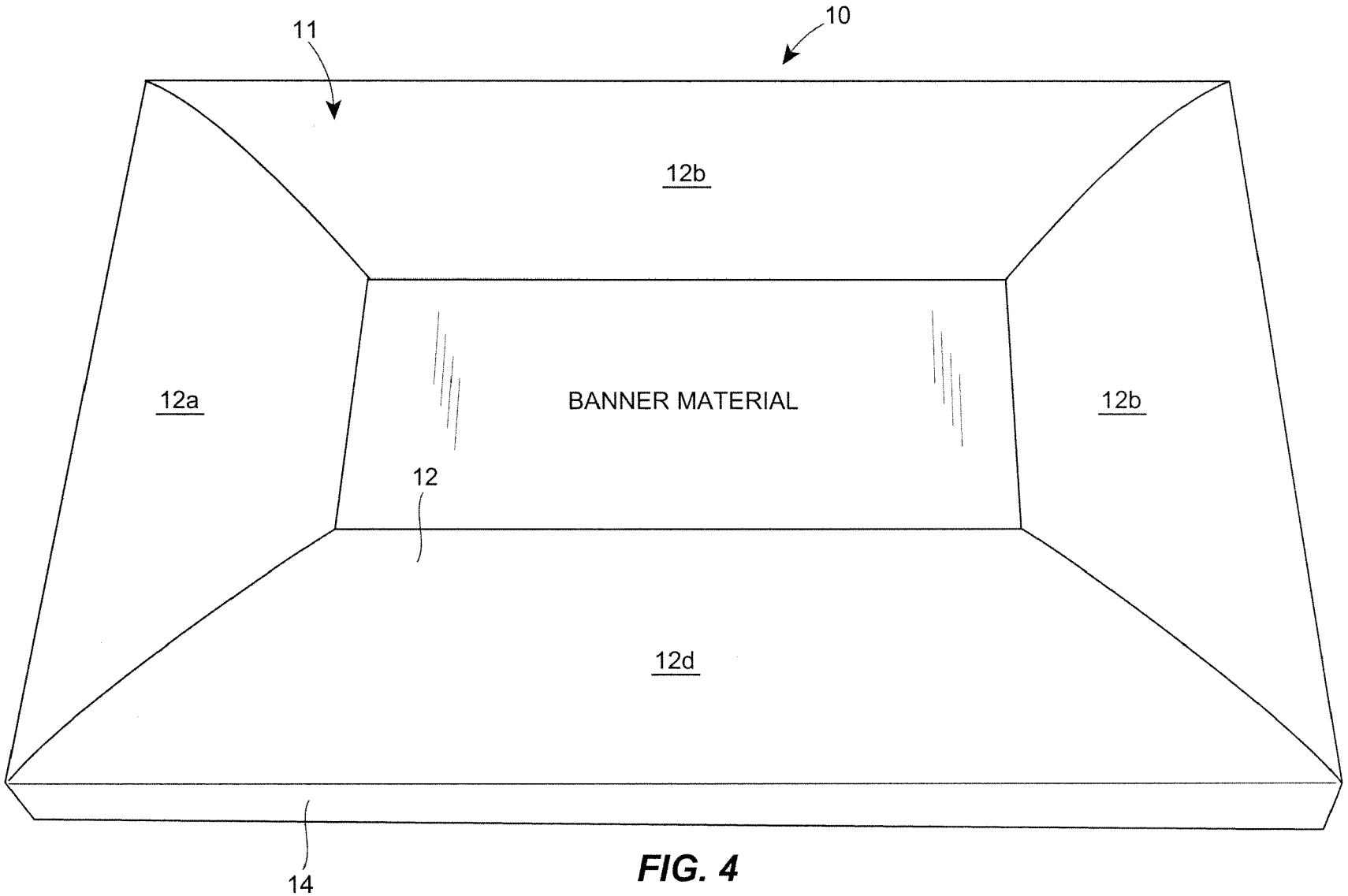
FIG. 4 is a perspective view of a banner mounting assembly according to the present disclosure.

Referring now to FIG. 4, a banner mounting assembly 10 is shown. The banner mounting assembly 10 includes a frame assembly 11 having top frame 12 and a bottom frame 14 disposed beneath the top frame. The top frame 12 has four sections 12*a*, 12*b*, 12*c* and 12*d*. A banner 16 or other advertisement media is disposed within the frame assembly 11. Each of the top frame sections 12*a*, 12*b*, 12*c*, and 12*d* is hinged to the bottom frame 14 (FIG. 5) by leaf spring tensioning. U.S. Pat. No. 4,145,828, for example, provides a detailed example of leaf spring tensioning, which is commonly known to persons of ordinary skill in the art. This hinge mechanism allows the top frame sections 12*a*, 12*b*, 12*c*, and

12*d* to be moved between a closed position, as shown in FIG. 4, and an open position, as later shown and described, enabling the banner 16 to be easily and securely placed within the frame assembly 11.

The banner mounting assembly 10 is capable of both inside and outside use, as the banner mounting assembly 10 will not rust, drip or corrode during use. Specifically, the frame assembly 11 and top and bottom frames 12, 14 may be made of high grade aluminum alloy and stainless steel, for example, or other materials that allow both inside and outside use without such effects.

Figure 5:
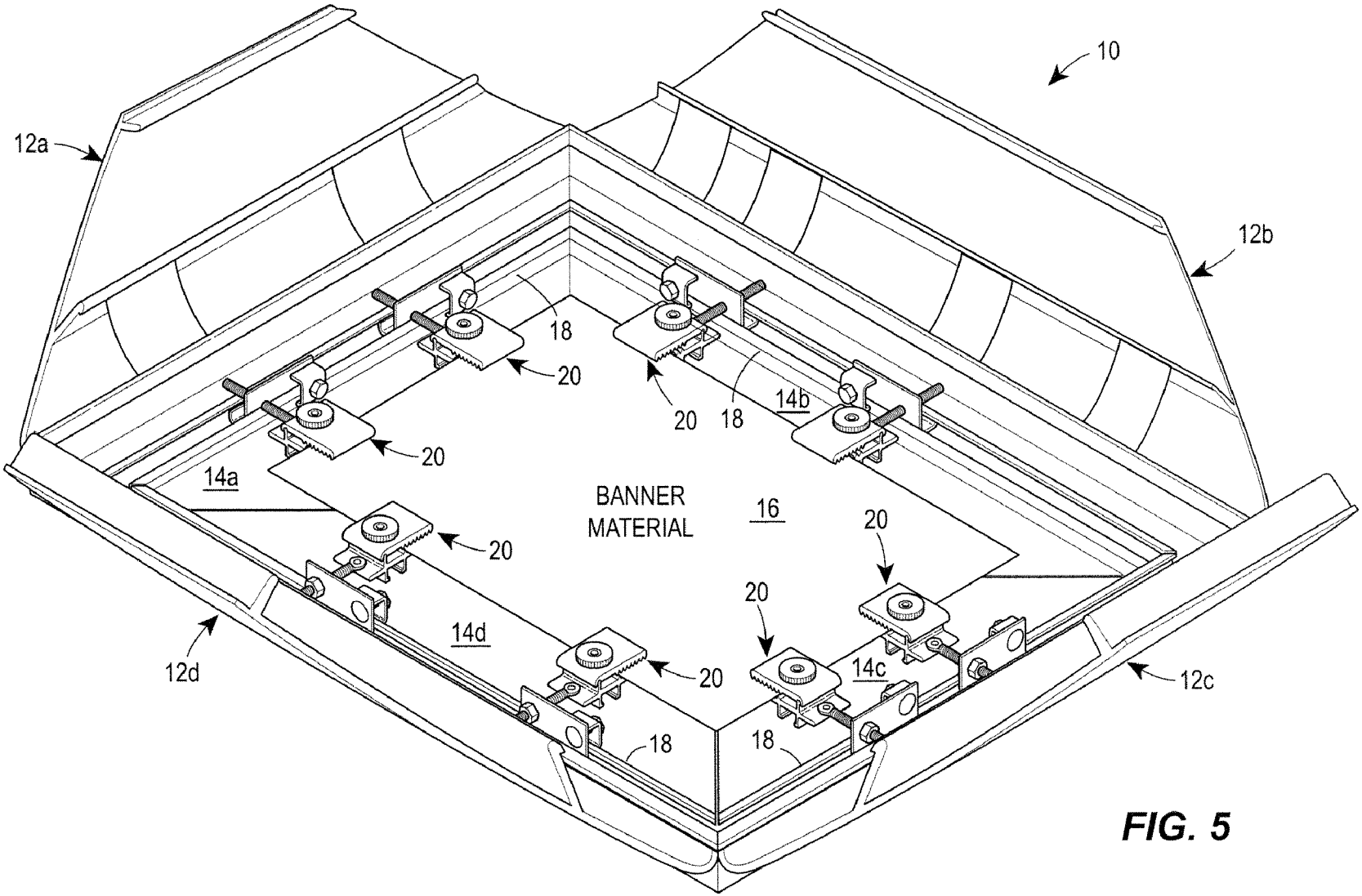
FIG. 5 is a perspective view of the banner mounting assembly according to the present disclosure, wherein four sections of a frame assembly of the banner mounting assembly are in an open position.

Referring now to FIG. 5, each of the top frame sections 12*a*, 12*b*, 12*c* and 12*d* of the frame assembly 11 are shown in an open position, exposing various internal components of the frame assembly 11 of the banner mounting assembly 10. Like the top frame 12, the bottom frame 14 includes four sections 14*a*, 14*b*, 14*c*, 14*d*. A rail 18 is disposed on each section 14*a*, 14*b*, 14*c*, and 14*d* of the bottom frame 14, and two clamp assemblies 20 are disposed on the rail 18 of each bottom frame section 14*a*, 14*b*, 14*c*, and 14*d*. In one example, the clamp assemblies 20 are disposed about 18 to 24 inches apart on each bottom frame section 14*a*, 14*b*, 14*c*, and 14*d*; however, this spacing is dependent upon the size of the frame assemblies. Additional clamp assemblies 20 may be inserted or removed at any time from any section of the bottom frame 14 to accommodate banners 16 or advertisement media of all sizes. After the banner 16 is disposed within the frame assembly 11, the clamp assemblies 20 secure and tension the banner 16 therein, as discussed in more detail below.

Figure 6:
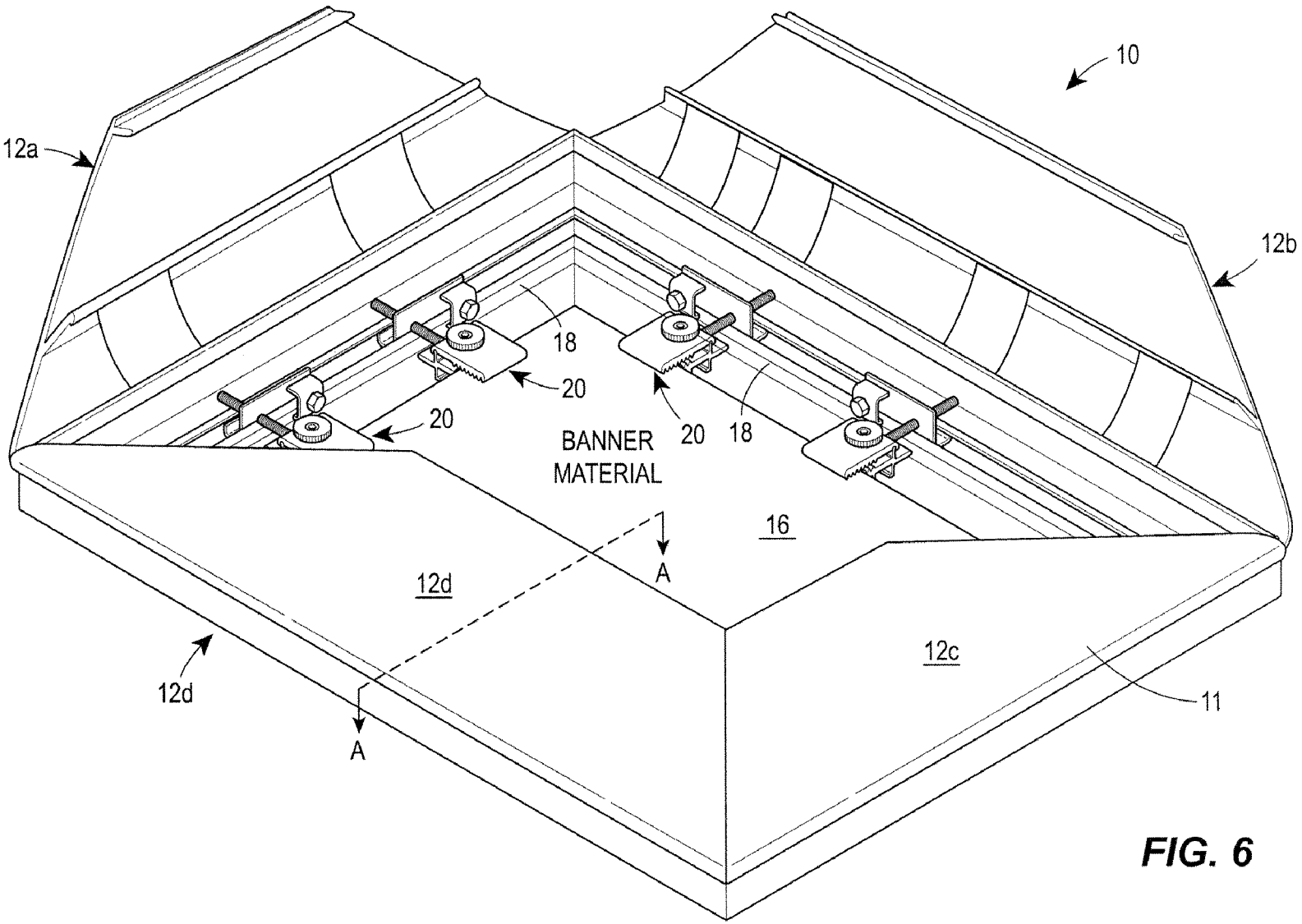
FIG. 6 is a perspective view of the banner mounting assembly according to the present disclosure, wherein two sides of the frame assembly of the banner mounting assembly are in an open position and two sides are in a closed position.

Referring now to FIG. 6, when the banner 16 is properly secured to the frame assembly 11 via the clamp assemblies 20, the top sections 12*a*, 12*b*, 12*c*, and 12*d* may be placed in a closed position. For example, in FIG. 6, top sections 12*c* and 12*d* have been moved to a closed position. Once all the top sections 12*a*, 12*b*, 12*c* and 12*d* are placed in a closed position (FIG. 4), only the frame assembly 11 and banner 16 are shown, thereby hiding all the clamp assemblies 20 and other components of the banner mounting assembly 10 that are not aesthetically pleasing. The banner mounting assembly 10 may then be attached to a mounting surface and a very clean, sturdy, tensioned banner 16 and banner mounting assembly 10 are provided.

Figure 7:
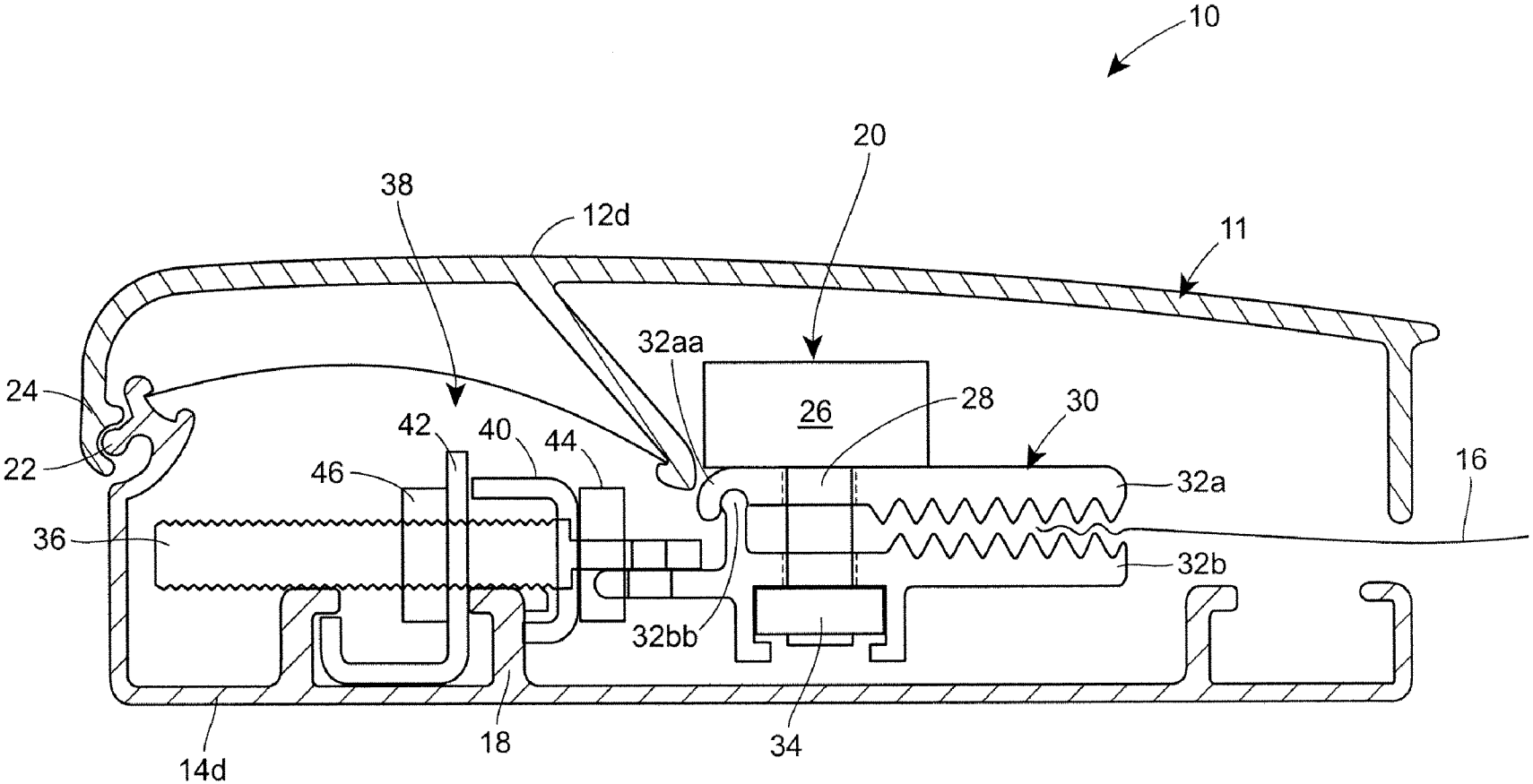
FIG. 7 is a cross-sectional view of the banner mounting assembly of the present disclosure taken along the lines A-A in FIG. 6.

Referring now to FIG. 7, a cross sectional view of the banner mounting assembly 10 is shown, taken along the lines A-A in FIG. 6. The top frame section 12*d* is in a closed position and is secured to the bottom frame section 14*d* via a hinge 22. In this example, the hinge 22 is an integral part of bottom frame section 14*d*. The top frame section 12*d* includes a hinge receiving area 24 for receiving the hinge 22, thereby enabling a leaf spring tensioned-hinged configuration. While this hinged configuration is shown for the top frame section 12*d* and the bottom frame section 14*d* only, each of the other bottom frame sections 14*a*, 14*b* and 14*c* includes the same integral hinge 22, and each of the corresponding top frame sections 12*a*, 12*b*, and 12*c* includes the same hinge receiving area 24 for receiving the hinge 22. This hinged configuration between the top and bottom frames 12, 14 enables all four sections 12*a*, 12*b*, 12*c* and 12*d* of the top frame 12 to be easily opened to accommodate the banner 16 or other advertisement media between the top and bottom frames 12, 14.

As shown in FIG. 7, each clamp assembly 20 includes a screw, such as a finger grip head 26 and a hex socket screw 28, for initial finger tightening. Extra tightening may be achieved using a hex key. Each clamp assembly 20 further includes a hinged clamp 30 that may be made of a variety of materials, preferably extruded aluminum. The clamp includes two jaws 32*a*, 32*b* for receiving and adhering to edges of the banner 16 or other advertisement media. The jaw 32*a* includes an integral hinge receiving section 32*aa* for receiving an integral hinge 32*bb* of jaw 32*b*, thereby allowing the jaws 32*a*, 32*b* to easily open and close for re-use. The sections of the jaws 32*a*, 32*b* that adhere to the edges of the banner 16 are serrated, but are not sharp enough to puncture the banner edges. The serrated sections of the jaws 32*a*, 32*b* may resemble interlocking teeth, as shown. To close the jaws 32*a*, 32*b* of the clamp 30, a square nut 34 mates with the finger grip head 26 and hex socket screw 28.

The jaws 32*a*, 32*b* are designed to accommodate any thickness of banner stock, such as vinyl, that may have hemmed pole sockets or grommets pre-installed. Most banners are prefabricated with one of pole pockets and grommets, or both, and the banner mounting assembly 10 will accommodate banners 16 with those features, without further modification. If banners 16 are to be made specifically for use in the banner mounting assembly 10, the banners 16 need only be made with raw cut edges to work with the frame assembly 11, thus eliminating the expense of additional pole pockets or grommets or both. The jaws 32*a*, 32*b* will also accommodate rigid, but flexible substrates, such as plastics and sheet metals, for example, eliminating the waviness on their surfaces after stretched in the frame assembly 11.

As also shown in FIG. 7, the clamp assembly 20 further includes a threaded member 36 that is attached to the clamp 30. The threaded member 36 allows a controlled and powerful outward tightening or tensioning of the banner 16 on all four sections of the top and bottom frames 12, 14. A retaining bracket 38 holds the clamp assembly 20, including threaded member 36, to the rail 18 on the frame assembly 11. Specifically, the retaining bracket 38 includes two portions 40 and 42 that straddle either side of the rail 18. Such portions 40 and 42 may be made of metal, for example. A first nut 44 tightens the retaining bracket 38 to the frame rail 18 after the retaining bracket 38 has been disposed on either side of the rail 18. A second nut 46 is disposed on the threaded member 36 at a side opposite the first nut 44. The second nut 46 pulls the clamp assembly 20 in an outward direction, thereby tensioning and keeping the banner 16 taut. While other methods of securing the clamp assembly 20 to the rail 18 exist, as described below, the retaining bracket 38 arrangement described above is the most secure design for the banner mounting assembly 10.

Figure 8:
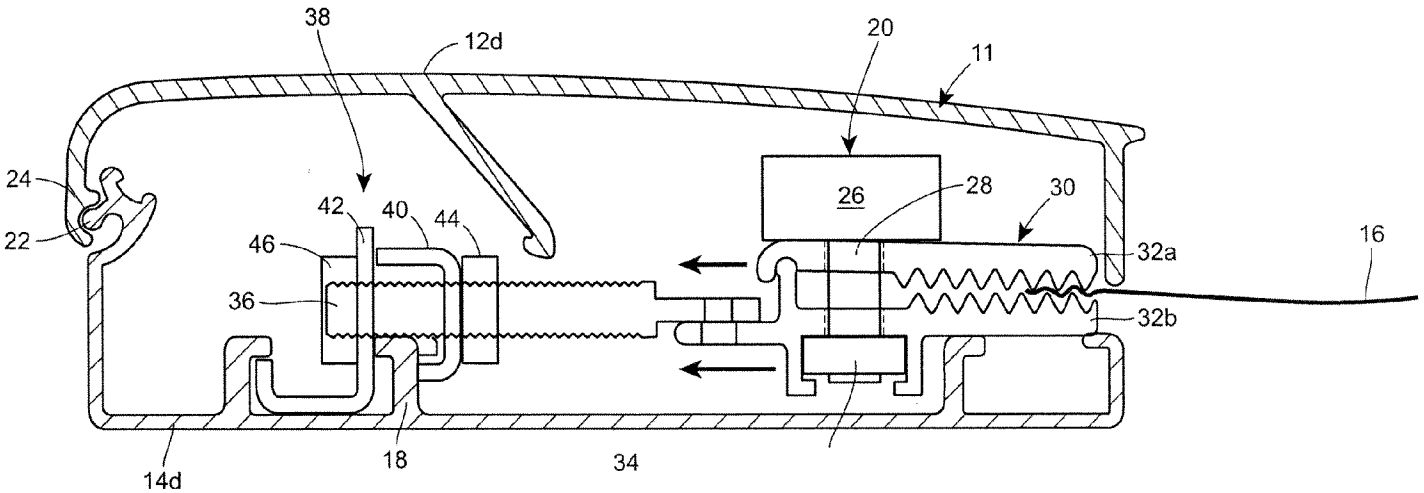
FIG. 8 is a cross-sectional view of the banner mounting assembly of the present disclosure showing a position of a threaded member before tensioning of a banner.
Figure 9:
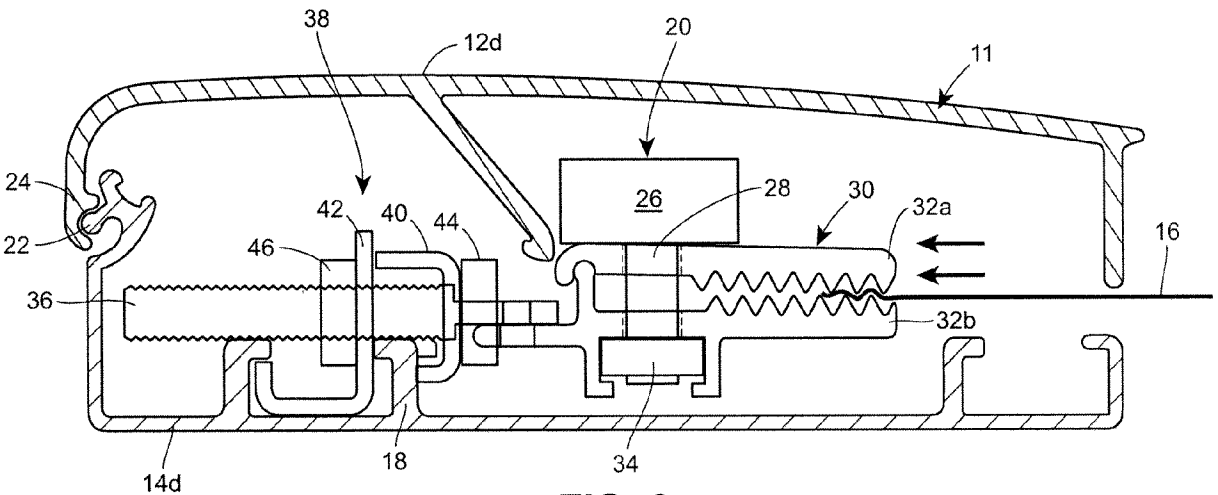
FIG. 9 is a cross-sectional view of the banner mounting assembly of the present disclosure showing the position of the threaded member after tensioning of the banner.

Referring now to FIGS. 8 and 9, FIG. 8 shows a banner 16 prior to being tensioned by the second nut 46 disposed on the threaded member 36. Specifically, the banner 16 is inserted into the clamp 30 of the clamp assembly 20. The finger grip head 26 of the clamp assembly 20 is then first tightened down by a user's fingers and then a hex key, for example. The second nut 46 is then tightened using a separate tool, e.g., a ⅜ inch open-ended wrench, such that the second nut 46 pulls the clamp assembly 20 back towards an outside perimeter of the frame assembly 11, thereby pulling the banner 16 or advertisement material or media tightly. FIG. 9 shows the clamp assembly 20 in a finished position, after complete tensioning of the banner 16 or advertisement media. In one example, the movement toward the outside perimeter of the frame assembly 11 is approximately one inch on each side, which easily accommodates the stretch or tensile properties of most banner materials.

Each clamp assembly 20 is accessible and adjustable from the top or front of the frame assembly 11 and may be easily added or removed after the frame is assembled and mounted. More specifically, while the frame assembly 11 and banner mounting assembly 10 stay on the wall, the clamp assemblies 20 and the banner 16 can be easily added, removed or relocated. Further, it is possible to remove or install an entire frame assembly 11 with the banner 16 from the wall without having to remove the banner 16. This is especially advantageous if desiring to hang the entire banner mounting assembly 10 to a ceiling, for example.

In another example, the frame assembly 11 may be made to allow any distance of outward clamp movement for very large banners. Specifically, the frame assembly size may be made to conform to the flat, but unstretched banner dimensions. This allows selectively spaced clamp assemblies 20 on all four sections of the top and bottom frames 12, 14 to attach to the banner sides in an unstretched position. Because some banner materials, such as fabric reinforced vinyl, have minimal stretch properties, slight outward pulling of the clamp assemblies 20 will sufficiently pull the banner tightly on all four sides.

Figure 10:
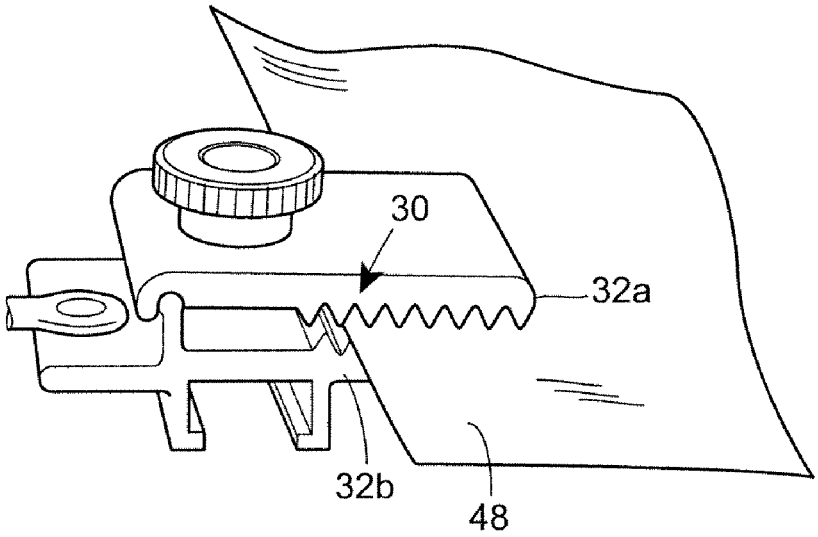
FIG. 10 is a side perspective view of a clamp assembly of the banner mounting assembly of the present disclosure clamping folded edges of the banner.

If the banner 16 is slightly oversized for the frame assembly 11, a user may also always fold the edges of the banner 16 and then insert the folded edges 48 into the clamp assembly 30. This still allows sufficient room for stretching the banner 16 tightly, as shown, for example, in FIG. 10.

Figure 10A:
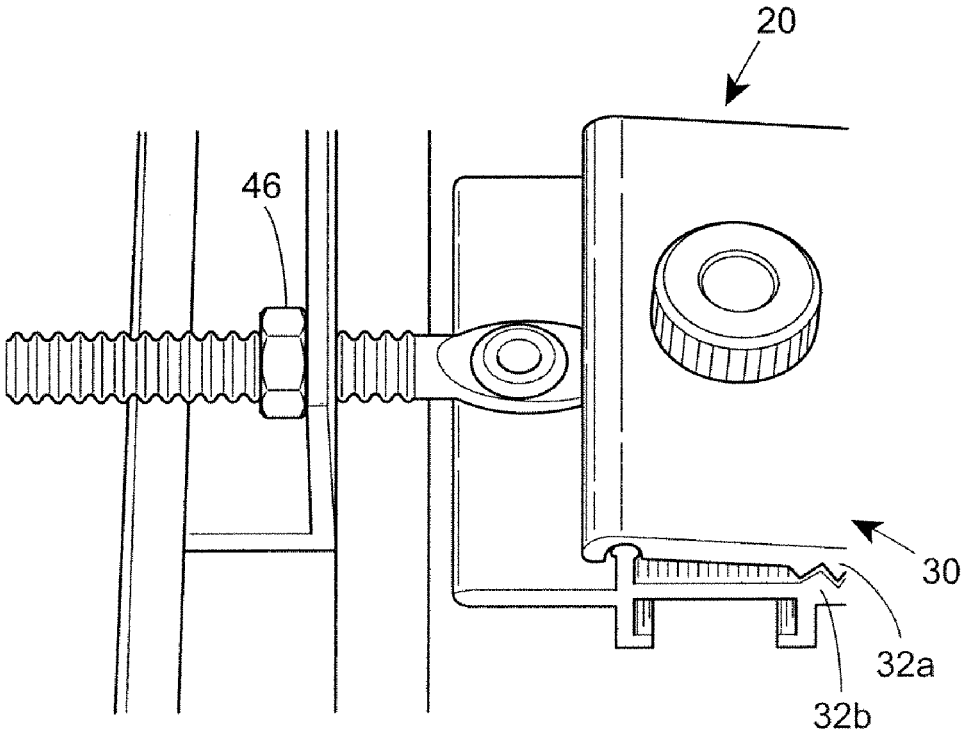
FIG. 10*a* is a top perspective view of an alternative clamp assembly of the banner mounting assembly of the present disclosure.

Referring now to FIG. 10*a*, a hex head screw 26*a*, instead of the finger grip head 26 (FIGS. 8, 9 and 10, for example), is used to tighten the jaws 32*a*, 32*b* of the clamp 30. The hex head screw 26*a* is oversized, allowing for initial finger gripping and tightening of the screw 26*a* to tighten down the jaws 32*a*, 32*b* on the banner material 16 (not shown). A conventional wrench, such as a ⅜ wrench, may then be used to fully tighten the jaws 32*a*, 32*b* of the clamp assembly 20 onto the banner material. The same conventional wrench may then be used to tighten the second nut 46 disposed on the threaded member 36. Thus, only one tool, e.g., the conventional wrench, is required to both tighten the jaws 32*a*, 32*b* and spin the second nut 46 to pull the clamp assembly 20 and tension the banner 16.

Figure 11:
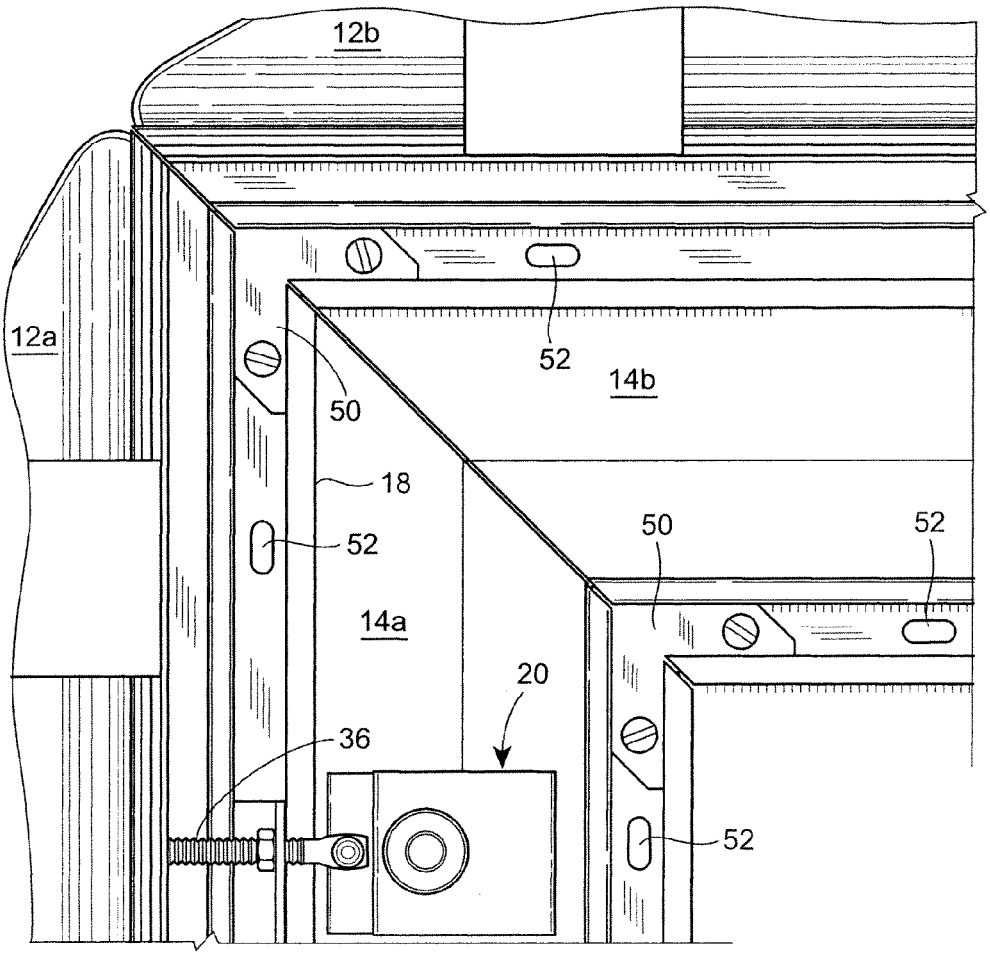
FIG. 11 is a top perspective view of a portion of a bottom frame of the banner mounting assembly of the present disclosure.

Referring now to FIG. 11, the banner mounting assembly 10 further includes two sets of corner brackets 50 for each corner of the frame assembly 11. For example, brackets 50 attach section 14*a* of the bottom frame 14 to the adjacent bottom frame section 14*b* of the frame assembly 11. Likewise, frame sections 14*c* and 14*d* are also attached to each other via corner brackets 50 (not shown). Although not shown in FIG. 11, one of ordinary skill in the art would understand that such corner brackets 50 are attached to each corner section of the frame assembly 11. More specifically, two sets of corner brackets 50 attach section 14*a* of the bottom frame 14 to section 14*d*, section 14*b* to section 14*c*, section 14*c* to section 14*d* and section 14*d* to section 14*a*. As one of ordinary skill in the art would also understand, each corner bracket 50 includes a backplate (not shown). The backplate is typically placed under each corner bracket 50 before the corner bracket 50 is tightened to the respective frame section.

The corner brackets 50 add extra rigidity to the frame assembly 11 and allow the frame assembly 11 to stretch out and display smaller banners without the need to wall mount the banner mounting assembly 10. This is especially useful for ceiling hanging displays, floor "lean-to" displays, and temporary trade show displays. Larger banners, however, require the frame assembly 11 to be adhered or screwed to a mounting surface, such as a wall, to provide the necessary rigidity.

In this example, the banner mounting assembly 10 also includes mounting recesses 52 for receiving a screw, thereby providing one manner of attaching or securing or mounting the banner mounting assembly 10 to a mounting surface, such as an exterior or interior wall. Specifically, the banner mounting assembly 10 should be mounted to the mounting surface by inserting screws in each of the mounting recesses 52, which will prevent inward stress of the frame assembly 11 when the banner 16 is stretched.

Figure 12:
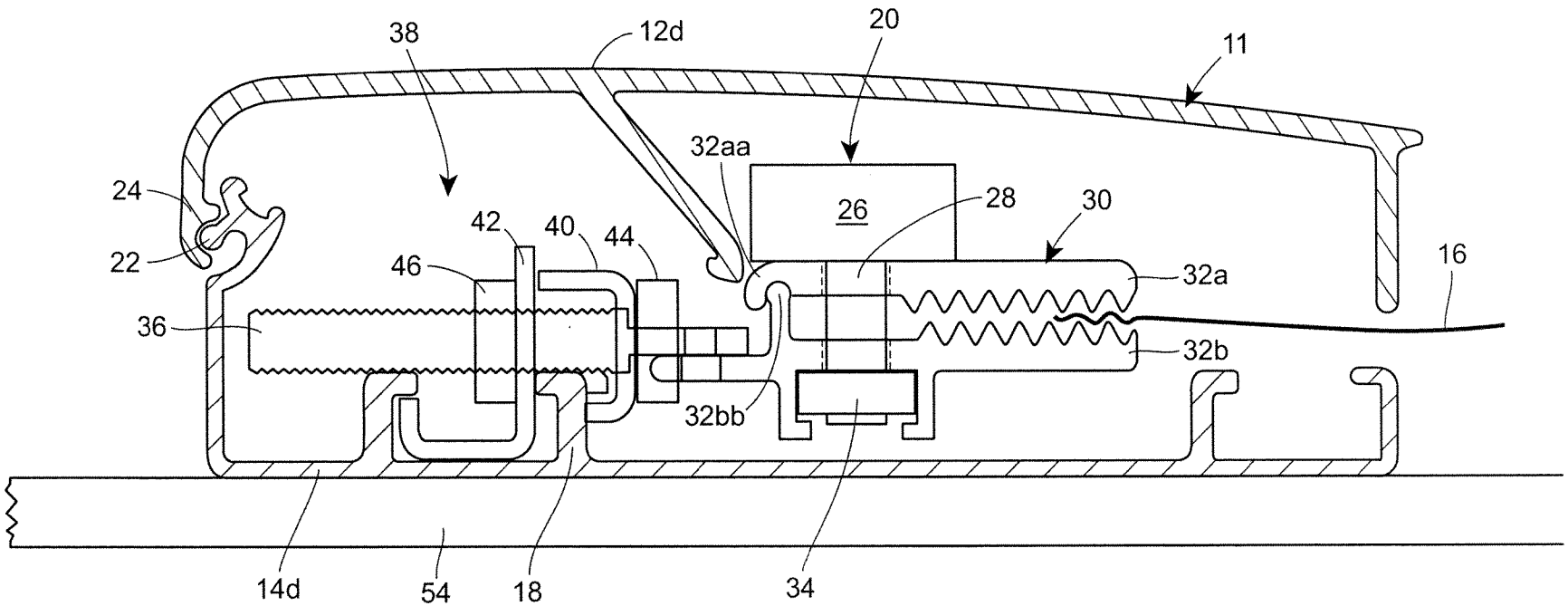
FIG. 12 is a cross-sectional view of the banner mounting assembly of the present disclosure showing the banner mounting assembly attached to a mounting surface.

Referring now to FIG. 12, a cross-sectional view of the banner mounting assembly 10 attached or adhered to a mounting surface 54 is shown. As noted, the mounting surface 54 may be an exterior wall surface, an interior wall surface, or a ceiling, for example, or any other surface that would allow the banner mounting assembly 10 to be secured thereto. The banner mounting assembly 10 is mounted directly to the mounting surface 54 such that there is no space or passageway disposed between the banner mounting assembly 10 and the mounting surface 54. In other words, each section 14*a*, 14*b*, 14*c*, and 14*d* of the bottom frame 14 contacts the mounting surface 54, preventing any wind or air to pass through the bottom frame 14 and reach the banner 16 from behind. A weather sealant strip (not shown) may also be placed under the frame assembly 11 when the banner mounting assembly 10 is mounted tightly to the mounting surface 54. This may further prevent wind, for example, from getting under the frame assembly 11 and into the back of the banner 16.

Figure 13:
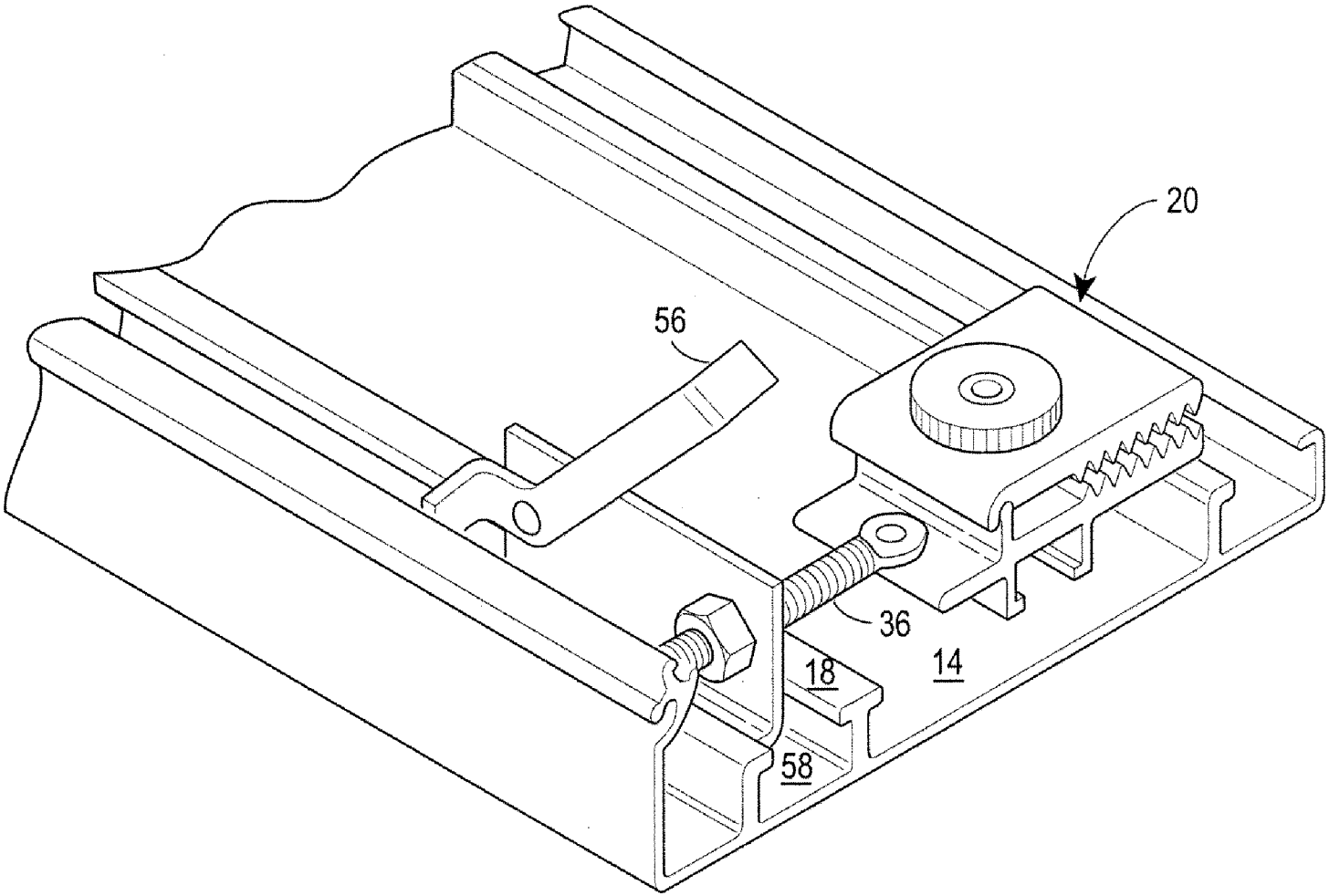
FIG. 13 is a perspective view of a first alternative embodiment of the banner mounting assembly of the present disclosure, wherein the clamp assembly and attached threaded member are in an unsecured position.
Figure 14:
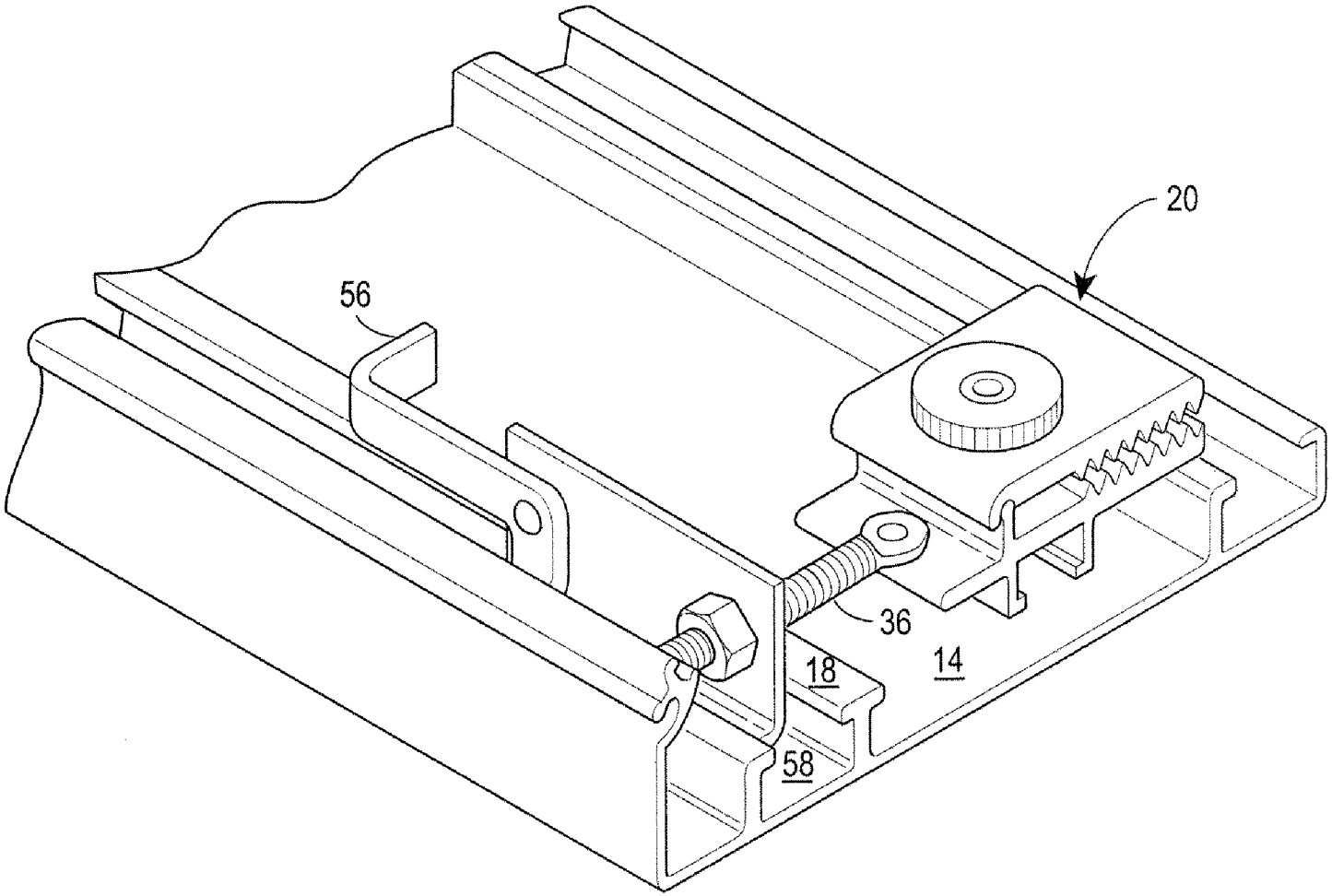
FIG. 14 is a perspective view of the first alternative embodiment of the banner mounting assembly of the present disclosure, wherein the clamp assembly and attached threaded member are in a secured position.

Referring now to FIGS. 13 and 14, a first alternative embodiment of the banner mounting assembly 10 of the present disclosure is shown. More specifically, a rotating lever 56 secures the clamp assembly 20 and attached threaded member 36 to the frame rail 18. The rotating lever 56 is part of the retaining bracket 38 and rotates into a frame channel 58 (see FIG. 13) to prevent the retaining bracket 38 from being removed from the rail 18. FIG. 13 shows the rotating lever 56 in a disengaged or unlocked position, such that the rotating lever 56 is removed from the frame channel 58. FIG. 14 shows the rotating lever 56 in an engaged or locked position, such that the rotating lever 56 is disposed within the frame channel 58, thereby securing the clamp assembly 20 and attached threaded member 36 to the frame rail 18.

Figure 15:
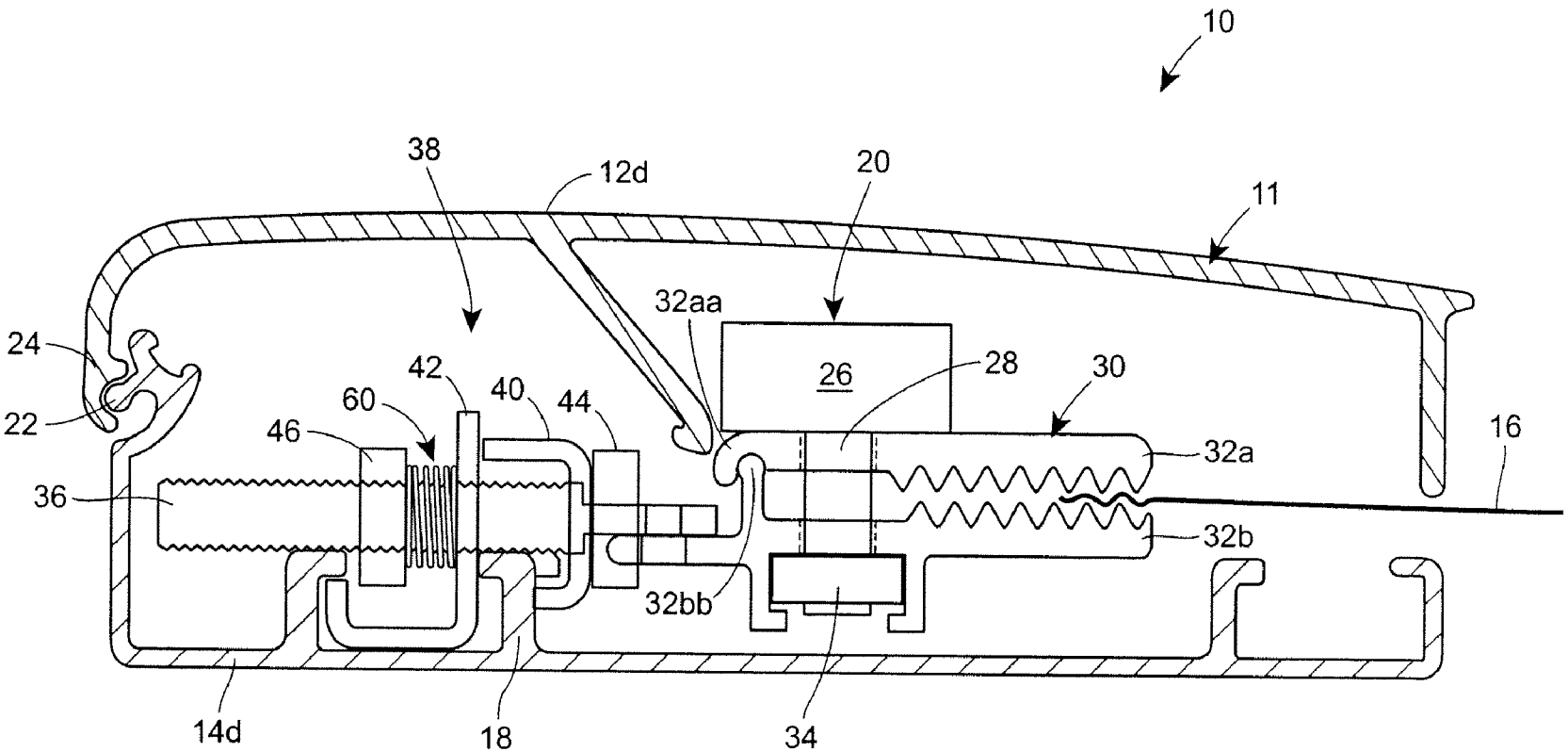
FIG. 15 is a cross-sectional view of a second alternative embodiment of the banner mounting assembly of the present disclosure.

A second alternative embodiment of the banner mounting assembly of the present disclosure is shown in FIG. 15. Specifically, a compression spring 60 is disposed between the tightening or second nut 46 and the retaining bracket 38 of the banner mounting assembly 10. The compression spring 60 has a compression load such that the banner 16 or other advertisement material is able to be pulled tightly, but the compression spring 60 is still extended allowing minimal clamp assembly 20 movement. Thus, the compression spring 60 enables the clamp assemblies 20 to react appropriately to banner expansion and contraction during temperature changes, making it less likely for the banner 16 or advertisement media to tear out of the clamp assemblies 20.

Figure 16:
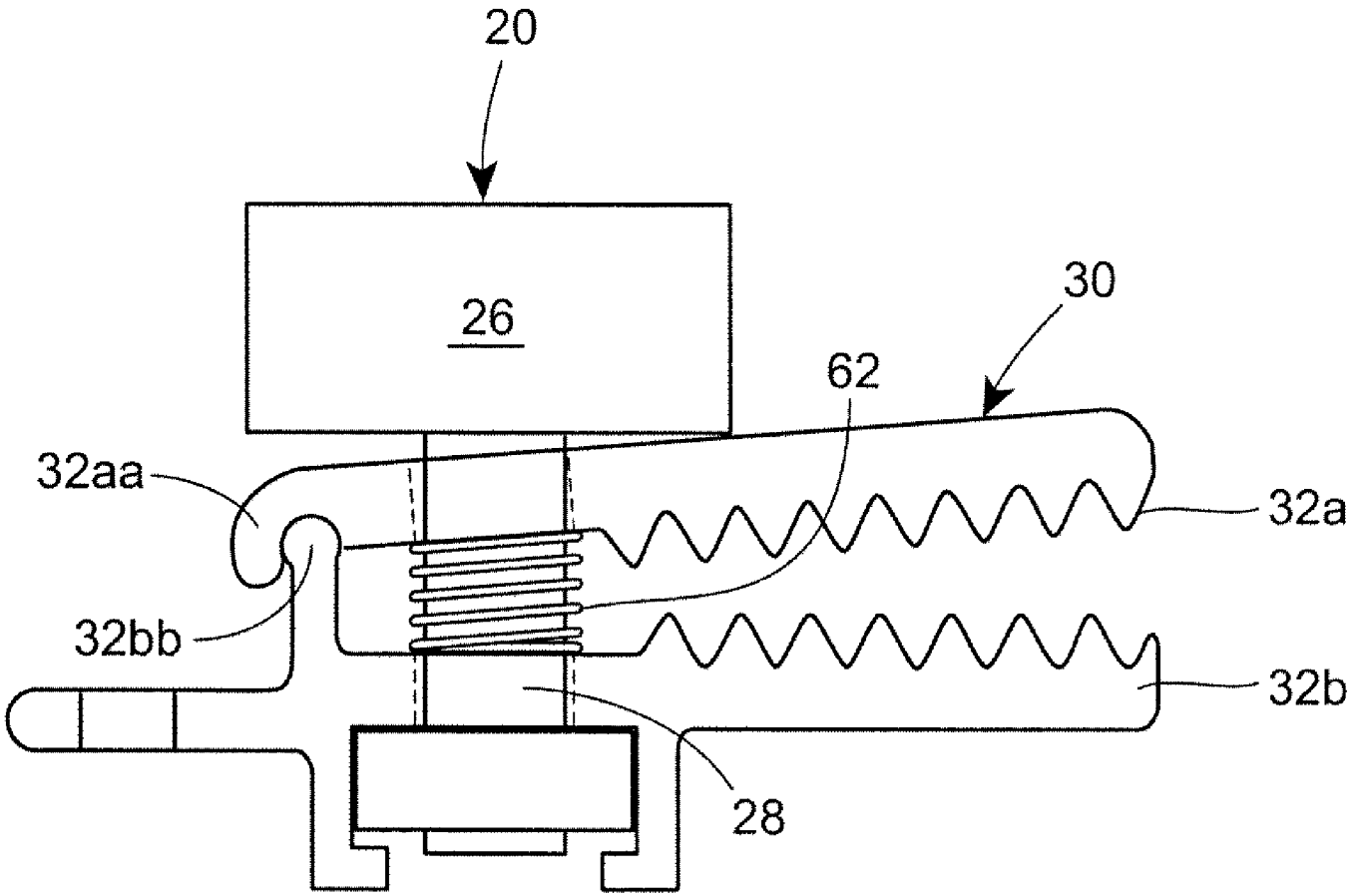
FIG. 16 is a cross-sectional view of a portion of a third alternative embodiment of the banner mounting assembly of the present disclosure.

Referring now to FIG. 16, a portion of a third alternative embodiment of the banner mounting assembly 10 of the present disclosure is shown. Specifically, a clamp assembly 20 of the third alternative embodiment is shown, which includes a compression spring 62 or belleville disc spring. The compression spring 62 is disposed between the jaws 32*a*, 32*b* of the clamp 30 to keep the clamp 30 in an open position before tightening the threaded screw 36 (not shown) attached to the clamp assembly 20. This facilitates mounting the clamp assembly 20 to the banner 16 or like material.

Figure 17A:
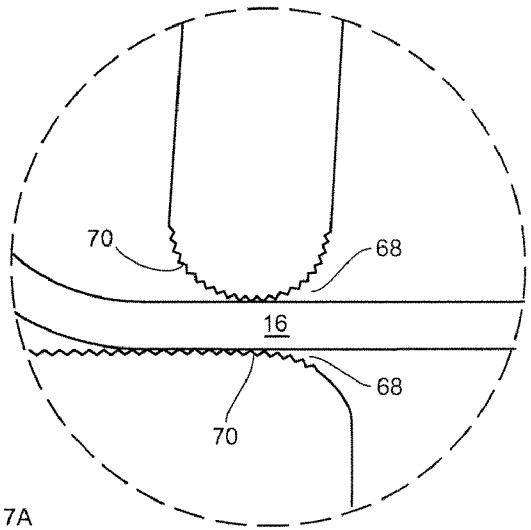
FIG. 17 is a cross-sectional view of a fourth alternative embodiment of the banner mounting assembly of the present disclosure.
Figure 17:
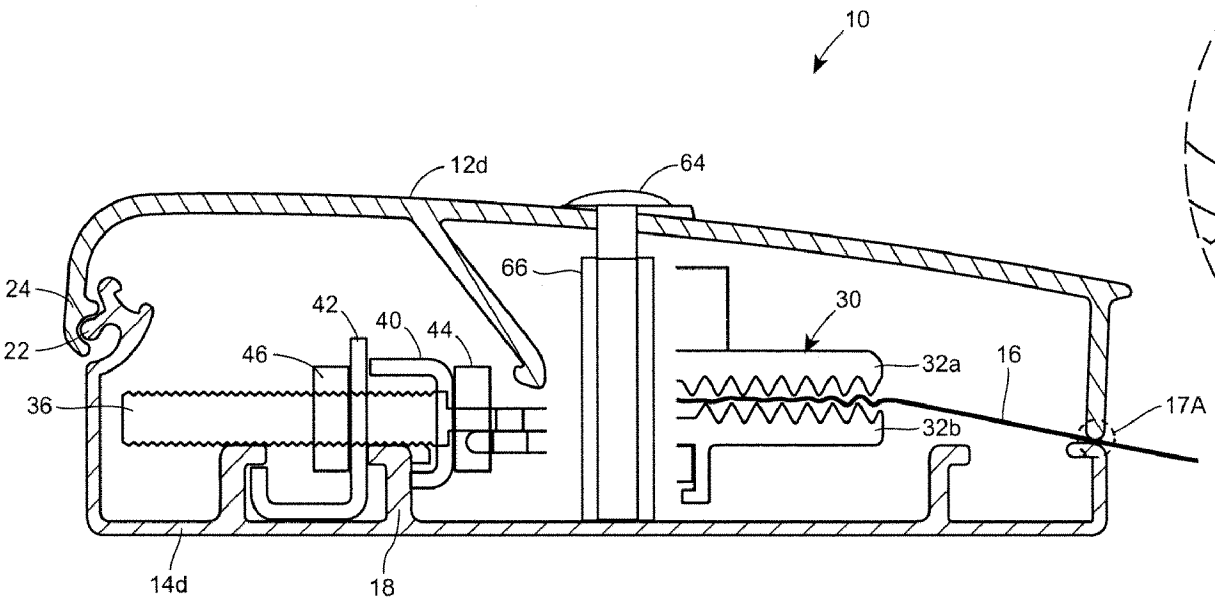

Referring now to FIG. 17, a fourth alternative embodiment of the banner mounting assembly 10 is shown. In this embodiment, a screw 64, such as a security screw, is provided. The screw or screws 64 push the top frame 12*d* towards the bottom frame 14*d*, thereby preventing unwanted access to internal components of the frame assembly 10 and avoiding unauthorized banner 16 or frame assembly 11 removal. The security screws 64 also stretch the banner 16, creating a secondary clamping action to grip the entire perimeter of the banner 16 by mating the top frame 12 to the bottom frame 14 of the frame assembly 11. A compressible rubber gasket (not shown) under the head of the screw 64 may be provided to protect the outside finish of the frame assembly 11.

As further shown in FIG. 17, a female threaded fixture 66 is mounted to the bottom frame 14*d*. These fixtures 66 may be located within the frame assembly 11 such that the screws 64 do not perforate the banner 16 or like material. These female threaded fixtures 66 may be located on the frame assembly 11 between the clamp assemblies 20, for example.

Further, mating edges 68 of the top and bottom frames 12, 14 of the frame assembly 11 may include small serrations 70, as also shown in FIG. 17. Such serrations 70 provide additional pressure to the banner 16 or like material along the entire perimeter of the banner 16 for added strength in retaining the banner 16 or other advertisement media.

The most common substrate for such banners 16 and printed advertisements is vinyl and fiber reinforced banner material. Other materials for the banner 16, such as semi-rigid plastic sheets, corrugated plastics, polystyrene, and sheet metals, may be effectively used with the banner mounting assembly 10 of the present disclosure.

Although certain banner mounting assemblies have been described herein in accordance with the teachings of the present disclosure, the scope of coverage of this patent is not limited thereto. On the contrary, this patent covers all embodiments of the teachings of the disclosure that fairly fall within the scope of permissible equivalents.

I claim:

1. A clamp assembly for gripping and tensioning a banner disposed within a banner mounting assembly, the clamp assembly comprising:

a clamp having a first jaw and a second jaw, the first and second jaws attached together at a first end by a hinge, such that the first and second jaws of the clamp open and close, and grip the banner at a second end disposed opposite the first end;

a screw disposed through the first and second jaws and a nut that mates with the screw to close the first and second jaws of the clamp; and a threaded member attached to the clamp, the threaded member adapted to tension the banner;

wherein the clamp assembly is adjustable from a top frame of the banner mounting assembly and may be added or removed after the banner mounting assembly is assembled and mounted to a mounting surface.

2. The clamp assembly of claim 1, wherein the first jaw includes an integral hinge receiving section for receiving an integral hinge of the second jaw.

3. The clamp assembly of claim 1, wherein the first and second jaws each have serrated teeth, such that the teeth of the first jaw interlock with the teeth of the second jaw, thereby allowing the first and second jaws to strongly grip, but not puncture, the banner.

4. The clamp assembly of claim 1, wherein the first and second jaws accommodate banner materials having a variety of thicknesses, such as ray, edge banners, banners with one or more of folded over edges, hemmed pole pockets, grommets, and semi-rigid substrates, such as plastics, polystyrene and sheet metals.

5. The clamp assembly of claim 1, further comprising a compression spring disposed between the first and second jaws of the clamp, wherein the compression spring keeps the clamp in an open position before the first and second jaws of the clamp close onto the banner.

6. The clamp assembly of claim 1, wherein the screw includes an oversized hex head screw that is initially gripped and tightened by a user's fingers and further tightened by a tool also used to tighten a second nut disposed on the threaded member.

7. A banner mounting assembly comprising:

a frame assembly for receiving a banner, the frame assembly having a top frame and a bottom frame hinged thereto, the bottom frame having a rail;

a plurality of clamp assemblies disposed on the rail of the bottom frame, each clamp assembly adapted to grip the banner and having a threaded member adapted to tension the banner;

a plurality of retaining brackets for securing the corresponding plurality of clamp assemblies to the rail of the bottom frame; and a mounting recess disposed on the bottom frame, the mounting recess adapted to receive a screw for attaching the banner mounting assembly to a mounting surface, such that no space exists between the banner mounting assembly and the mounting surface;

wherein the hinged top and bottom frames enable the top frame to be moved between an open position and a closed position, thereby allowing access to each clamp assembly in the open position and only displaying the banner and frame assembly in the closed position; and wherein each retaining bracket includes two portions that straddle either side of the rail, a first nut that tightens the retaining bracket to the frame rail, and a second nut disposed on the threaded member for pulling the clamp assembly and tensioning the banner.

8. The banner mounting assembly of claim 7, wherein each of the top and bottom frames include four sections, and two clamp assemblies are disposed on the rail of each of the bottom frame sections, thereby allowing each side of the banner to be secured and tensioned within the frame assembly of the banner mounting assembly.

9. The banner mounting assembly of claim 8, wherein each bottom frame section includes a hinge, and each top frame section includes a corresponding hinge receiving area, thereby enabling a leaf spring tensioned hinged configuration between the top frame and bottom frame of the frame assembly.

10. The banner mounting assembly of claim 7, wherein each retaining bracket includes a rotating lever that rotates into a frame channel, thereby securing each clamp assembly to the rail of the bottom frame.

11. The banner mounting assembly of claim 7, further comprising at least one bracket for each corner of the frame assembly, thereby adding rigidity to the frame assembly and allowing the frame assembly to tension and display smaller banners without having to wall mount the banner mounting assembly.

12. The banner mounting assembly of claim 7, wherein the mounting surface includes one of an exterior wall surface, an interior wall surface, and a ceiling, and the entire frame assembly may be removed from the mounting surface without having to remove the banner from the frame assembly.

13. The banner mounting assembly of claim 7, wherein the top and bottom frames include edges having serrations, wherein the serrations provide additional pressure to the banner along a perimeter of the banner and, therefore, added strength in retaining the banner.

14. A method of tensioning a banner, the method comprising the steps of:

inserting the banner into at least one clamp assembly, wherein each clamp assembly is disposed on a bottom frame of a frame assembly and includes a clamp having a first jaw and a second jaw hinged to the first jaw;

tightening a screw of each clamp assembly and mating a nut with the screw to close the clamp of each clamp assembly, thereby allowing each clamp to grip the banner; and pulling the banner toward a perimeter of the frame assembly using a nut disposed on a threaded member of each clamp assembly, thereby tensioning the banner.

15. A method of displaying and tensioning a banner disposed within a banner mounting assembly, the method comprising the steps of:

inserting the banner into a frame assembly, the frame assembly having a top frame and a bottom frame hinged thereto, the bottom frame having a rail;

placing edges of the banner into a plurality of clamp assemblies disposed on the rail of the bottom frame, each clamp assembly adapted to grip the banner;

tightening a screw of each clamp assembly and mating a nut with the screw to close the clamp, thereby allowing each clamp to grip the banner; and pulling the banner toward an outside perimeter of the frame assembly using a nut disposed on a threaded member of each clamp assembly, thereby tensioning the banner;

wherein the hinged top and bottom frames enable the top frame to be moved between an open position and a closed position, allowing access to each clamp assembly disposed on the bottom frame during the open position and only displaying the banner and frame assembly in the closed position.

16. The method of displaying and tensioning a banner of claim 15, further comprising the step of securing the plurality of clamp assemblies to the rail of the bottom frame using a plurality of corresponding retaining brackets.

17. The method of displaying and tensioning a banner of claim 15, further comprising the step of mounting the banner mounting assembly to a mounting surface, wherein no space exists between the banner mounting assembly and the mounting surface.

18. The banner mounting assembly of claim 7, wherein a compression spring is disposed between the second nut and the retaining bracket, such that the compression spring remains in an extended position when the banner is being tensioned.

19. A banner mounting assembly comprising:

a frame assembly for receiving a banner, the frame assembly having a top frame and a bottom frame hinged thereto, the bottom frame having a rail;

a plurality of clamp assemblies disposed on the rail of the bottom frame, each clamp assembly adapted to grip the banner and having a threaded member adapted to tension the banner;

a plurality of retaining brackets for securing the corresponding plurality of clamp assemblies to the rail of the bottom frame;

a mounting recess disposed on the bottom frame, the mounting recess adapted to receive a screw for attaching the banner mounting assembly to a mounting surface, such that no space exists between the banner mounting assembly and the mounting surface; and a security screw disposed through the top frame of the frame assembly and a fixture disposed on the bottom frame for receiving the security screw, wherein the security screw pushes the top frame toward the bottom frame and prevents unwanted access to the frame assembly;

wherein the hinged top and bottom frames enable the top frame to be moved between an open position and a closed position, thereby allowing access to each clamp assembly in the open position and only displaying the banner and frame assembly in the closed position.

* * * * *